US009153375B2

(12) United States Patent
Köhler et al.

(10) Patent No.: US 9,153,375 B2
(45) Date of Patent: Oct. 6, 2015

(54) TEMPERATURE SENSING SYSTEM FOR POWER ELECTRONIC DEVICE

(75) Inventors: Bernd Köhler, Forchheim (DE); Richard H. Osman, Pittsburgh, PA (US); Stefan von Dosky, Karlsruhe (DE); Herbert Schorb, Karlsruhe (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 395 days.

(21) Appl. No.: 13/586,553

(22) Filed: Aug. 15, 2012

(65) Prior Publication Data

US 2014/0049880 A1 Feb. 20, 2014

(51) Int. Cl.
*H01F 27/40* (2006.01)
*H01F 27/16* (2006.01)

(52) U.S. Cl.
CPC ..... *H01F 27/402* (2013.01); *H01F 27/16* (2013.01); *H01F 2027/406* (2013.01)

(58) Field of Classification Search
CPC ..... H02B 1/56; H01F 27/16; H01F 27/402; H01F 2027/406
USPC ..... 361/700, 677; 363/71, 8; 324/95; 340/8.1
See application file for complete search history.

(56) References Cited

U.S. PATENT DOCUMENTS 5,590,031 A * 12/1996 Mead et al. ..... 363/8
5,625,545 A * 4/1997 Hammond ..... 363/71
6,806,699 B2 * 10/2004 Hameury ..... 324/95
8,416,571 B2 * 4/2013 Mizumura et al. ..... 361/695
8,711,530 B2 * 4/2014 Ledezma et al. ..... 361/42
2004/0158428 A1 * 8/2004 Byrd et al. ..... 702/182
2011/0044010 A1 * 2/2011 Ledezma et al. ..... 361/727
2013/0005372 A1 * 1/2013 Strei et al. ..... 455/500
2013/0093567 A1 * 4/2013 Garman et al. ..... 340/8.1

FOREIGN PATENT DOCUMENTS

EP 2431985 A1 3/2012
GB 1475407 A 6/1977

OTHER PUBLICATIONS

"Wireless Temperature Monitoring System", XP055084234, Retrieved from the Internet: URL: http://static.schneider-electric.us/docs/Electrical Distribution/0180IB0801.pdf [retrieved on Oct. 16, 2013]; the whole document; 2011; Jan. 1, 2011.

(Continued)

*Primary Examiner* — Anthony Haughton
*Assistant Examiner* — Matt Dhillon

(57) ABSTRACT

A power electronic device is disclosed. The power electronic device may include a housing, a conductive element positioned within the housing and rated for at least a medium voltage, a cooling system in fluid communication with the conductive element, a plurality of temperature sensing tags and a data collection unit having a receiver that is configured to receive signals from the antennae of the temperature sensing tags. The cooling system may have a plurality of outlet conduit elements that are positioned within the housing. Each of the tags may be attached to one of the outlet conduits and may include a power supply, a temperature sensor, and an antenna.

8 Claims, 4 Drawing Sheets

(56) References Cited

OTHER PUBLICATIONS

Mei-Sung Kang, et al.: "ZigBee Wireless network for transformer load monitoring and temperature sensitivity analysis," Industry Applications Society Annual Meeting (IAS), 2011 IEEE, pp. 1-12, XP031990516; 2011; US; Oct. 9, 2011.

PCT International Search Report mailed Oct. 28, 2013 corresponding to PCT International Application No. PCT/US2013/054827 filed Aug. 14, 2013 (13 pages).

* cited by examiner

TEMPERATURE SENSING SYSTEM FOR POWER ELECTRONIC DEVICE

BACKGROUND

The use of power electronic devices such as a set of inverters to control a motor drive or other electrically powered device is well known. Components of one prior art motor control system are shown in FIG. 1. FIG. 1 illustrates various embodiments of a power supply (such as an AC motor drive) having nine such power cells. The power cells in FIG. 1 are represented by a block having input terminals A, B, and C; and output terminals T1 and T2. In FIG. 1, a transformer or other multi-winding device 110 receives three-phase, medium-voltage power at its primary winding 112, and delivers power to a load 130 such as a three-phase AC motor via an array of single-phase inverters (also referred to as power cells) 151-153, 161-163, and 171-173. Each phase of the power supply output is fed by a group of series-connected power cells, called herein a "phase-group" 150, 160 and 170.

The transformer 110 includes primary windings 112 that excite a number of secondary windings 114-122. Although primary windings 112 are illustrated as having a star configuration, a mesh configuration is also possible. Further, although secondary windings 114-122 are illustrated as having a delta or an extended-delta configuration, other configurations of windings may be used as described in U.S. Pat. No. 5,625,545 to Hammond, the disclosure of which is incorporated herein by reference in its entirety. In the example of FIG. 1 there is a separate secondary winding for each power cell. However, the number of power cells and/or secondary windings illustrated in FIG. 1 is merely illustrative, and other numbers are possible. Additional details about such a power supply are disclosed in U.S. Pat. No. 5,625,545.

Several functional components of inverters can be subject to high thermal stress during operation. When high temperatures occur, such as a result of temporary overload operation or other operation outside of base ratings, inner temperatures of the components can reach or exceed critical temperatures. Such systems may be cooled by circulating cool water and/or air through the components in order to absorb heat and reduce the component temperature. Nonetheless, it is desirable to sense the temperature of the component to identify when the component approaches a critical temperature.

The large number of temperature measuring locations in a power electronic circuit, and the high thermal stress conditions of operation, make it difficult to adequately sense the temperature of a power electronic device.

This document describes methods and systems that attempt to solve at least some of the problems described above, and/or other problems.

SUMMARY

In an embodiment, a power electronic device may include a housing, a conductive element positioned within the housing and rated for at least a medium voltage, a cooling system in fluid communication with the conductive element, a plurality of temperature sensing tags and a data collection unit having a receiver that is configured to receive signals from the antennae of the temperature sensing tags. The cooling system may have a plurality of outlet conduit elements that are positioned within the housing. Each of the tags may be attached to one of the outlet conduits and may include a power supply, a temperature sensor, and an antenna.

DETAILED DESCRIPTION

As used in this document and in the appended claims, the singular forms "a," "an," and "the" include plural reference unless the context clearly dictates otherwise. Unless defined otherwise, all technical and scientific terms used in this document have the same meanings as commonly understood by one of ordinary skill in the art. As used in this document, the term "comprising" means "including, but not limited to."

Figure 1:
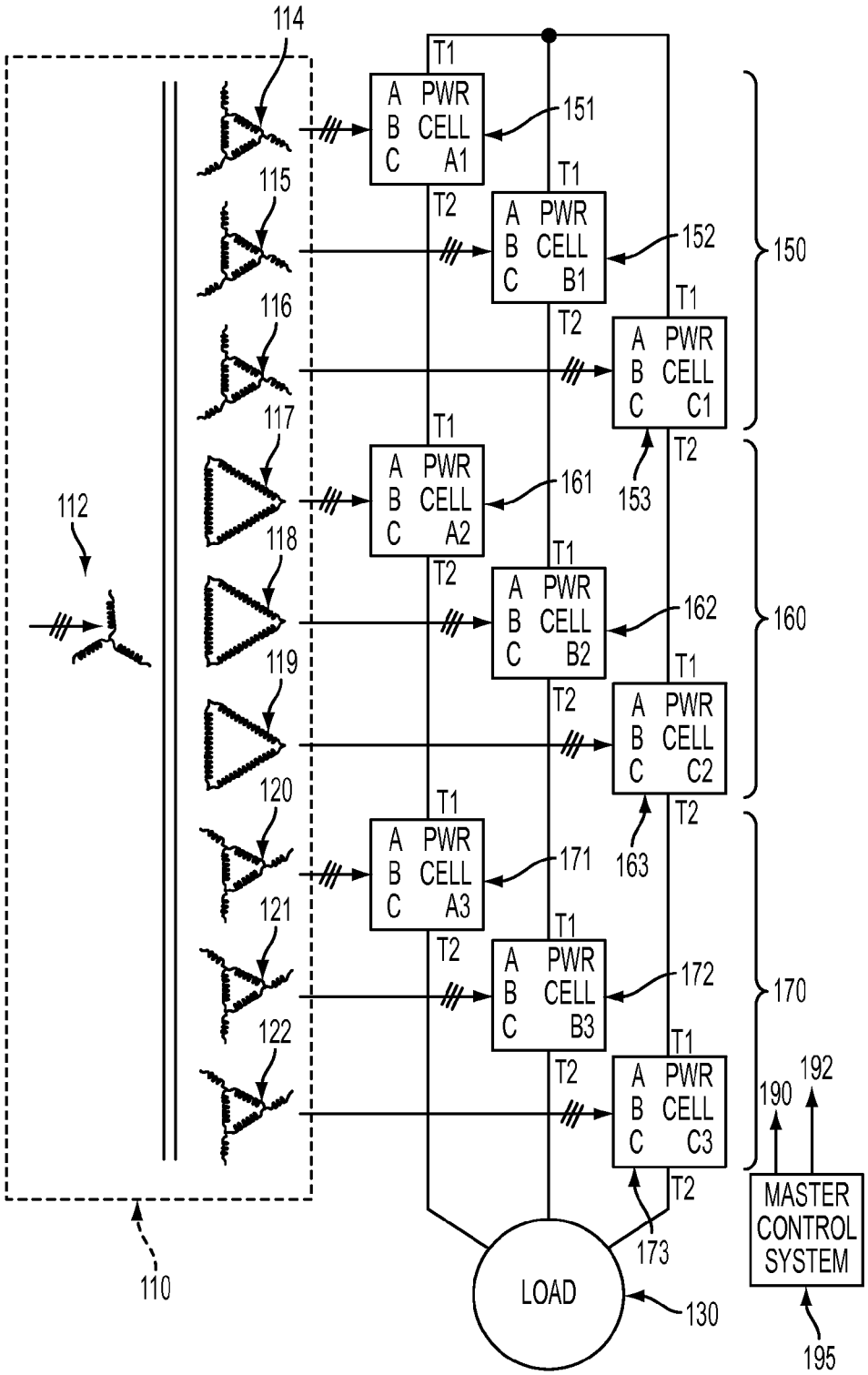
FIG. 1 PRIOR ART
FIG. 1 illustrates an embodiment of a prior art power system for reducing harmonic distortion and correcting power factor.

Electronic drive systems such as those illustrated in FIG. 1 are commonly-used power electronic devices that may control loads such as medium voltage motors. As described above, such systems may use inverters or other power cells 151-153, 161-163, 171-173. In operation, the cells are subject to high thermal stress, due to time-varying power loss. When higher temperatures occur, as in the case of temporary overload operation or other operation outside the cell's base ratings, inner temperatures of these or other power electronic devices components can reach or exceed critical temperatures.

For long-term reliable operation, it is desirable to monitor the temperature of power electronic devices. Components that may be monitored include, but are not limited to, inductors, transformers and semiconductor devices (IGBT, MOSFET, thyristors, etc.). However, the large number of temperature measuring locations in a power electronic device creates a challenge because the locations are often at a high voltage potential with respect to ground and to each other. Therefore it is a problem to have power supply and data wires to communicate with the sensors which are in contact with high voltage. In addition, these locations are in a powerful electromagnetic environment, caused by large currents containing high harmonics, as well as high alternating voltages. The sensors generate very small electrical signals which could easily be disturbed by the strong electromagnetic fields, which poses yet another challenge.

Figure 2:
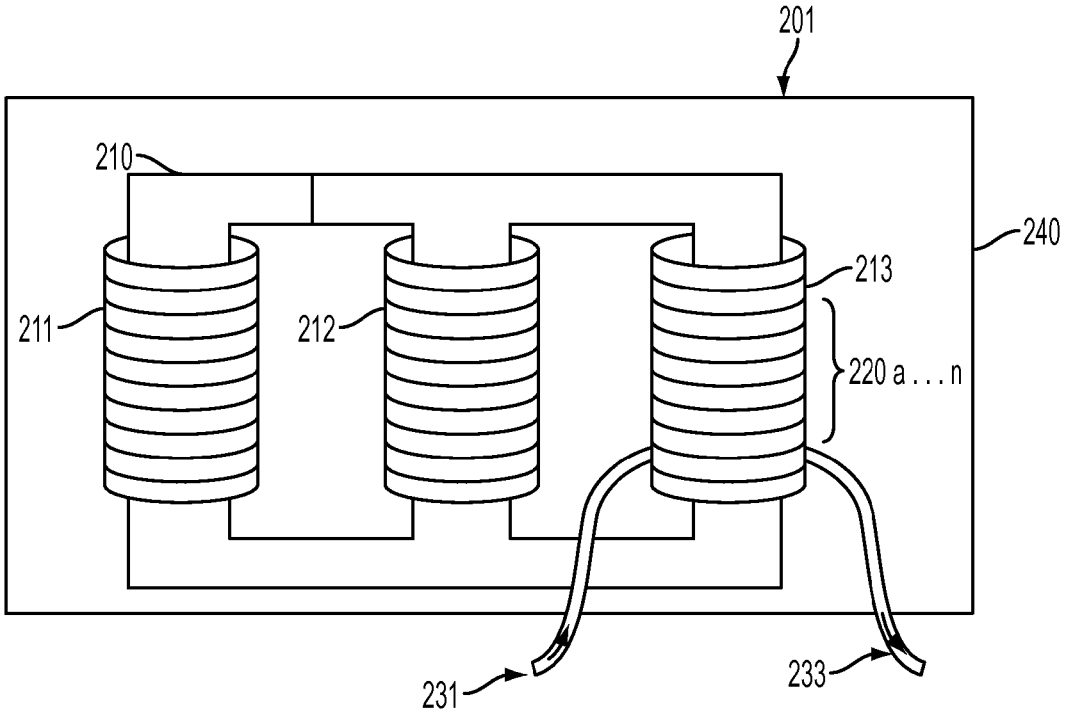
FIG. 2 illustrates an example of a power electronic device and cooling system.

FIG. 2 illustrates a system that addresses challenges such as those described above. FIG. 2 illustrates the system in the context of a three-phase, medium voltage transformer 201. As used in this document, "medium voltage" generally refers to voltages that are denoted in the field of power as such. Examples include 1 kilovolts (kv)-35 kv, 600 volts-69 kv, 2.4 kv-39 kv, or any combination of the upper and lower limits of these ranges. However, the system may be used with other power electronic devices as well. FIG. 2 illustrates the secondary side of a three-phase, medium voltage transformer including a conductive core 210 and three phases that 211, 212, 213 that each include a set of primary winding and secondary windings 220*a* . . . 220*n*. In a medium voltage transformer, any number of secondary windings may be used as conductive elements, such as 15-20 secondaries per phase, each having 5-20 turns each. Other configurations are possible. Some or all of the transformer components may be contained in a housing 240.

A cooling system is in fluid communication with the conductive element. The cooling system may one or more conduits that circulate air, water, or other gas or liquid through the area of the conductive elements. As shown in FIG. 2, the cooling system for one phase of the transformer includes an inlet conduit 231 and an outlet conduit 233 that are at least partially positioned within the housing 240. Multiple inlet and outlet conduits may be included for each phase.

Figure 3:
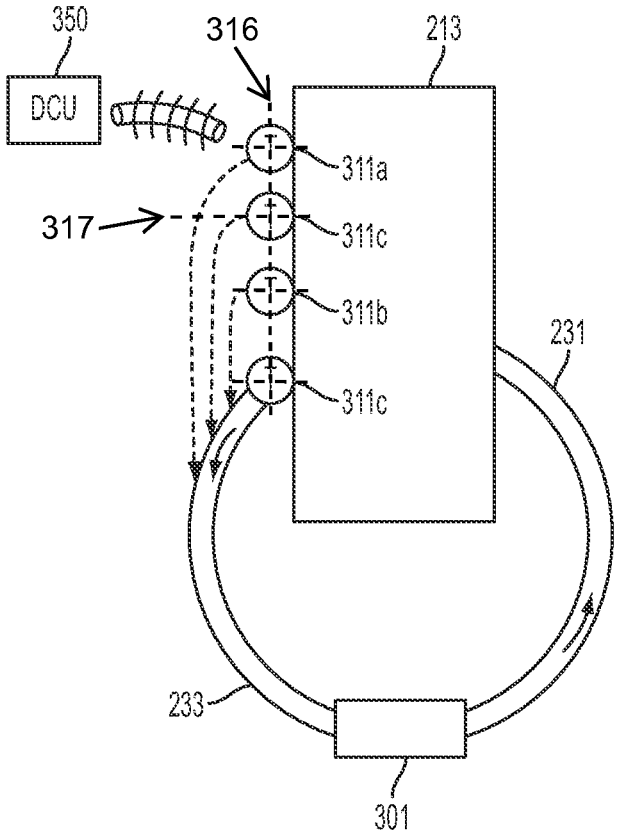
FIG. 3 illustrates various components of a temperature sensing system for one or more components of a power electronic device.

FIG. 3 illustrates a system that focuses on one component 213 of the power electronic device, in this case one phase of the transformer. Referring to FIG. 1, the phase may include a set of conductive coils 213, and the system includes a cooling unit 301, and inlet conduit 231 and an outlet conduit 233. Fluid or gas is cooled by the codling unit 301, send to component 213 via the inlet conduit 231 where it absorbs heat. The fluid or gas then returns to the cooling unit 301 via the outlet conduit 233. Multiple inlet and outlet conduits may be used, each of which returns to the same cooling unit. Alternatively, multiple cooling units may be used.

Figure 4:
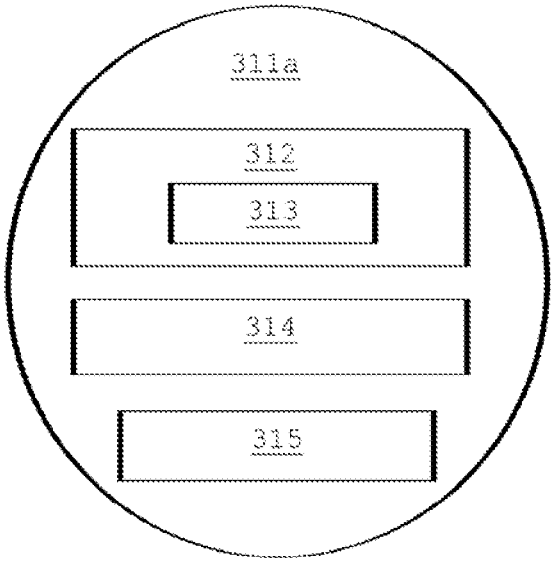
FIG. 4 illustrates various components of a temperature sensing tag of a temperature sensing system for one or more components of a power electronic device.

A temperature sensing tag 311*a* is positioned to contact the outlet conduit 213 and detect the temperature of the outlet conduit. Optionally, any number of temperature sensing tags 311*a* . . . 311*n* may be used, such as one tag for each conduit. The temperature sensing tags 311*a* . . . 311*n* may be positioned within the transformer housing, optionally at or very near to the point where the conduit interfaces with the component. The tags 311*a* . . . 311*n* may be oriented so that the tags 311*a* . . . 311*n* are each positioned along an axis 316 that is substantially perpendicular to an axis 317 of each of its neighboring tags, to reduce the risk of arcing. As FIG. 4 shows, the temperature sensing tags 311*a* . . . 311*n* may each include a power supply 312, a temperature sensor 314, and an antenna 315 so that they can wirelessly send signals corresponding to the sensed temperature to a remote data collection unit. The power supply 312 may include an additional device 313, which can be for example a battery or a thermoelectric device. In some embodiments, the power supply 312 may include a battery. In other embodiments, the power supply 312 may comprise a thermoelectric device that can generate a voltage due to the temperature differential between a hot outlet tube and air inside an enclosure.

Optionally, the tags may be of the type known as radio frequency identification (RFID) tags, which serve as passive temperature sensors. The additional device 313 may be for example an energy storage device. In some embodiments, the tags 311*a* . . . 311*n* may harvest energy from ultra high frequency (UHF) fields, capture the energy and store it in an energy storage device (such as an internal capacitor) for use as a power source. The tag may sense the temperature when the storage device's charge reaches a threshold (such as substantially or fully loaded), and then transmit a signal with the sensed temperature along with an identification code for the tag. For example, the power supply for a tag may include an induction coil positioned to harvest magnetic energy from a field near the windings (or other components) when the windings are operational and convert the magnetic energy to a voltage. Other configurations are possible. In some embodiments, the power supply may include a battery. In other embodiments, the power supply may be a thermoelectric device that can generate a voltage due to the temperature differential between a hot outlet tube and air inside an enclosure.

The signals from the tags are received by one or more data collection units 350 that are configured to receive signals from the antennae of the temperature sensing tags. Each data collection unit may include a transmitter, a processor, and a memory. The memory may contain programming instructions that, when executed, the processor to send, via the transmitter, a polling signal to one or more of the temperature sensing tags. The polling signal may actuate a response that the data collection unit 350 will receive and use to determine the temperature sensed by the tag.

Data communication between the tags and data collection unit may occur by any suitable means. For example, the communication may use radio waves at VHF or UHF frequencies. If so, sensing data and sensor identification data for a tag may be stacked together in a short telegram and sent via the tag's antenna to the transmitter station. All the involved tags/sensors may operate in the same manner and send a data telegram in the data collection unit at periodic intervals, such as every 30 seconds. This may be accomplished by "blind" transmissions, where each tag emits its signal in an uncoordinated manner on a carrier frequency, common for all sensor elements. The repetition rate is may be preset to any suitable time, such as about 30 seconds. If the telegrams of two or more sensors collide, the probability for interference between the telegrams could be reduced by arbitrarily choosing small repetition time offsets (added to the basic period while sensor presetting, for instance at assembly time) and another additional small variation per sensor on a cycle by cycle base. The data collection unit may continuously listen for telegrams, identifies the sender of each telegram, and assembles the data in a bundle to be transferred it to an automation/monitoring unit. Alternative, all the sensor elements may be controlled by the transmission unit. If so, the sensors may not emit any signal until they are interrogated by a message from the data collection unit. The triggers may be coordinated to give enough idle time to every sensor to gather and store enough energy to be able to answer on the next request.

In various embodiments, it may sufficient to gather sensed temperature values within time periods of about 30 seconds. This may be sufficient for most cases of power electronic circuits, where the size of the involved components is so large as to limit the maximum slope of temperature change over time. Other configurations may require shorter or longer cycles. Taking 30 seconds as an example, then a reasonable time division is 1 second for data transfer (proposing an upper limit) and 29 seconds for energy harvesting. If the sensor element handles both the harvesting and communication in parallel, then uninterrupted harvesting would be possible.

While several embodiments of the invention have been described in this document by way of example, those skilled in the art will appreciate that various modifications, alterations, and adaptations to the described embodiments may be realized without departing from the spirit and scope of the invention defined by the appended claims.

What is claimed is:

1. A power electronic device, comprising:

a housing;

a conductive element positioned within the housing and rated for at least a medium voltage;

a cooling system in fluid communication with the conductive element, the cooling system comprising a plurality of outlet conduits that are positioned within the housing;

a plurality of temperature sensing tags, wherein each of the tags is attached to one of the outlet conduits and comprises a power supply, a temperature sensor, and an antenna; and a data collection unit comprising a receiver that is configured to receive signals from the antennae of the temperature sensing tags, wherein each of the temperature sensing tags is oriented to be positioned along an axis that is substantially perpendicular to an axis of each of its neighboring temperature sensing tags.

2. The device of claim 1, wherein:

the conductive element comprises a multi-phase transformer;

each phase of transformer comprises a plurality of windings;

the cooling system comprises a water cooling system in fluid communication with at least one of the windings.

3. The device of claim 1, wherein the power supply comprises a battery.

4. The device of claim 1, wherein the power supply comprises a thermoelectric device.

5. The device of claim 1, wherein the power supply comprises an induction coil positioned to harvest magnetic energy from a field near the windings when the windings are operational and convert the magnetic energy to a voltage.

6. The device of claim 1, wherein the power supply comprises:

an antenna positioned to harvest electromagnetic energy from a field near the windings when the windings are operational and convert the electromagnetic energy to a voltage.

7. The device of claim 6 wherein the data collection unit further comprises a transmitter, a processor, and a memory containing programming instructions configured to instruct the processor to send, via the transmitter, a polling signal to one or more of the temperature sensing tags.

8. The device of claim 1, wherein at least one of the temperature sensing tags comprises an energy storage device configured to store a charge, and wherein the at least one of the temperature sensing tags transmits an identifier and data representative of sensed temperature when the stored charge reaches a threshold.

* * * * *